US005461736A

United States Patent [19]

Carpenter et al.

[11] Patent Number: 5,461,736

[45] Date of Patent: Oct. 31, 1995

[54] PORTABLE HYDRAULIC LIFT STEP STOOL FOR RAISING HANDICAPPED PATIENTS TO AN ELEVATED LOCATION

[76] Inventors: Joyce A. Carpenter, P.O. Box 124, Oxford Junction, Iowa 52323-0124; Merlin L. Conklin, P.O. Box 2033, Cleveland, Tex. 77328-2033

[21] Appl. No.: 242,423

[22] Filed: May 13, 1994

[51] Int. Cl.[6] ..... A61G 7/053; A61G 7/10

[52] U.S. Cl. ..... 5/81.1; 5/662; 182/141; 187/244; 254/93 R; 414/921

[58] Field of Search ..... 5/81.1, 611, 662; 187/240, 244; 182/141; 254/2 R, 93 R; 414/921; 4/565.1

[56] References Cited

U.S. PATENT DOCUMENTS

| | | | |
|---|---|---|---|
| 2,050,000 | 8/1936 | Frost | 254/93 R |
| 2,725,578 | 12/1955 | Keller | 4/565.1 |
| 2,751,191 | 6/1956 | Schroeder | 254/93 R |
| 3,232,377 | 2/1966 | Smith | 182/141 |
| 3,668,723 | 6/1972 | Bratton | 297/5 |
| 3,963,096 | 6/1976 | Jones | 182/148 |
| 4,875,555 | 10/1989 | Johansson et al. | 5/86.1 |
| 5,155,873 | 10/1992 | Bridges | 297/417 |
| 5,161,812 | 11/1992 | De Weese | 297/347 |
| 5,217,090 | 6/1993 | Billington, III et al. | 182/141 |
| 5,322,408 | 6/1994 | Wooden | 414/921 |

FOREIGN PATENT DOCUMENTS

| | | | |
|---|---|---|---|
| 8807848 | 10/1988 | WIPO | 5/81.1 |

*Primary Examiner*—Alexander Grosz

[57] ABSTRACT

A portable hydraulic lift step stool for raising handicapped patients to an elevated location comprising of a lower base positionable upon a floor, the lower base having parallel corner walls extending upwardly therefrom. An upper base having a planar surface, the upper surface of which is adapted to support a patient to be lifted and transported, the lower surface of which faces the lower base, the upper base having front and rear edges with a downwardly extending plate adapted to be positioned between the upwardly extending corner walls of the lower base. And a hydraulic jack having an upper end secured to the lower surface of the upper base and having a lower end secured to the upper surface of the lower base, the hydraulic jack including a handle extending outwardly from the upper base and lower base in a space between the corner walls of the lower base, the handle adapted to be pumped to raise and lower the hydraulic jack, the jack also having a switch for reversing the direction of movement of the jack.

1 Claim, 4 Drawing Sheets

PORTABLE HYDRAULIC LIFT STEP STOOL FOR RAISING HANDICAPPED PATIENTS TO AN ELEVATED LOCATION

BACKGROUND OF THE INVENTION

1. Field of the Invention

The present invention relates to portable hydraulic lift step stool for raising handicapped patients to an elevated location and more particularly pertains to raising patients to an elevated location such as an examining table or an x-ray table through a hydraulic lift step stool which is portable.

2. Description of the Prior Art

The use of devices for lifting and transporting patients in a hospital is known in the prior art. More specifically, lifting and transporting handicapped patients in a hospital heretofore devised and utilized for the purpose of lifting patients or transporting them in hospitals or other health care facilities are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,161,812 to DeWeese a travel-lift chair.

U.S. Pat. No. 5,155,873 to Bridges discloses an electrically operated lift stool.

U.S. Pat. No. 4,875,555 to Johansson discloses a patient lifting device.

U.S. Pat. No. 3,963,096 to Jones discloses a stepping stool with elevating platform and controls.

U.S. Pat. No. 3,668,723 to Bratton discloses a patient riser.

In this respect, the portable hydraulic lift step stool for raising handicapped patients to an elevated location according to the present invention substantially departs from the conventional concepts and designs of the prior art, and in doing so provides an apparatus primarily developed for the purpose of raising patients to an elevated location such as an examining table or an x-ray table through a hydraulic lift step stool which is portable.

Therefore, it can be appreciated that there exists a continuing need for improved devices such as the portable hydraulic lift step stool for raising handicapped patients to an elevated location which can be used for raising patients to an elevated location such as an examining table or an x-ray table through a hydraulic lift step stool which is portable. In this regard, the present invention substantially fulfills this need.

SUMMARY OF THE INVENTION

In view of the foregoing disadvantages inherent in the known types of devices for lifting and transporting patients in a hospital now present in the prior art, the present invention provides an improved portable hydraulic lift step stool for raising handicapped patients to an elevated location. As such, the general purpose of the present invention, which will be described subsequently in greater detail, is to provide a new and improved portable hydraulic lift step stool for raising handicapped patients to an elevated location and method which has all the advantages of the prior art and none of the disadvantages.

To attain this, the present invention essentially comprises a portable hydraulic lift step stool for raising handicapped patients to an elevated location comprising of a lower base positionable upon a floor, the lower base having parallel corner walls extending upwardly therefrom. An upper base having a planar surface, the upper surface of which is adapted to support a patient to be lifted and transported, the lower surface of which faces the lower base, the upper base having front and rear edges with a downwardly extending plate adapted to be positioned between the upwardly extending corner walls of the lower base. A hydraulic jack having an upper end secured to the lower surface of the upper base and having a lower end secured to the upper surface of the lower base, the hydraulic jack including a handle extending outwardly from the upper base and lower base in a space between the corner walls of the lower base, the handle adapted to be pumped to raise and lower the hydraulic jack, the jack also having a switch for reversing the direction of movement of the jack. Wheels depending from each corner of the lower base with an associated spring adapted to cushion the motion of the system when rolled from one location to the other, the wheels including locking mechanisms to secure the wheels against rotation during the raising and lowering of a patient. And a pair of inverted U-shaped handles extending upwardly from the side edges of the upper base, each handle including lower fixed components with vertically spaced apertures and an upper inverted U-shaped component with downwardly extending free ends positionable in the upper apertures of the lower components each with a locking tongue for securing the upper component at a fixed elevation with respect to the lower component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore a object of the present invention to provide new and improved portable hydraulic lift step stool for raising handicapped patients to an elevated location which have all the advantages of the prior art devices for lifting and transporting patients in a hospital and none of the disadvantages.

It is another object of the present invention to provide new and improved portable hydraulic lift step stool for raising handicapped patients to an elevated location which may be easily and efficiently manufactured and marketed.

It is further object of the present invention to provide new and improved portable hydraulic lift step stool for raising handicapped patients to an elevated location which are of durable and reliable constructions.

An even further object of the present invention is to provide new and improved portable hydraulic lift step stool for raising handicapped patients to an elevated location which are susceptible of a low cost of manufacture with regard to both materials and labor, and which accordingly are then susceptible of low prices of sale to the consuming public, thereby making such portable hydraulic lift step stool for raising handicapped patients to an elevated location economically available to the buying public.

Still yet another object of the present invention is to provide new and improved portable hydraulic lift step stool for raising handicapped patients o an elevated location which provide in the apparatuses and methods of the prior art some of the advantages thereof, while simultaneously overcoming some of the disadvantages normally associated therewith.

Still another object of the present invention is to raise patients to an elevated location such as an examining table or an x-ray table through a hydraulic lift step stool which is portable.

Lastly, it is an object of the present invention to provide new and improved portable hydraulic lift step stool for raising handicapped patients to an elevated location comprising of a lower base positionable upon a floor, the lower base having parallel corner walls extending upwardly therefrom. An upper base having a planar surface, the upper surface of which is adapted to support a patient to be lifted and transported, the lower surface of which faces the lower base, the upper base having front and rear edges with a downwardly extending plate adapted to be positioned between the upwardly extending corner walls of the lower base. And a hydraulic jack having an upper end secured to the lower surface of the upper base and having a lower end secured to the upper surface of the lower base, the hydraulic jack including a handle extending outwardly from the upper base and lower base in a space between the corner walls of the lower base, the handle adapted to be pumped to raise and lower the hydraulic jack, the jack also having a switch for reversing the direction of movement of the jack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
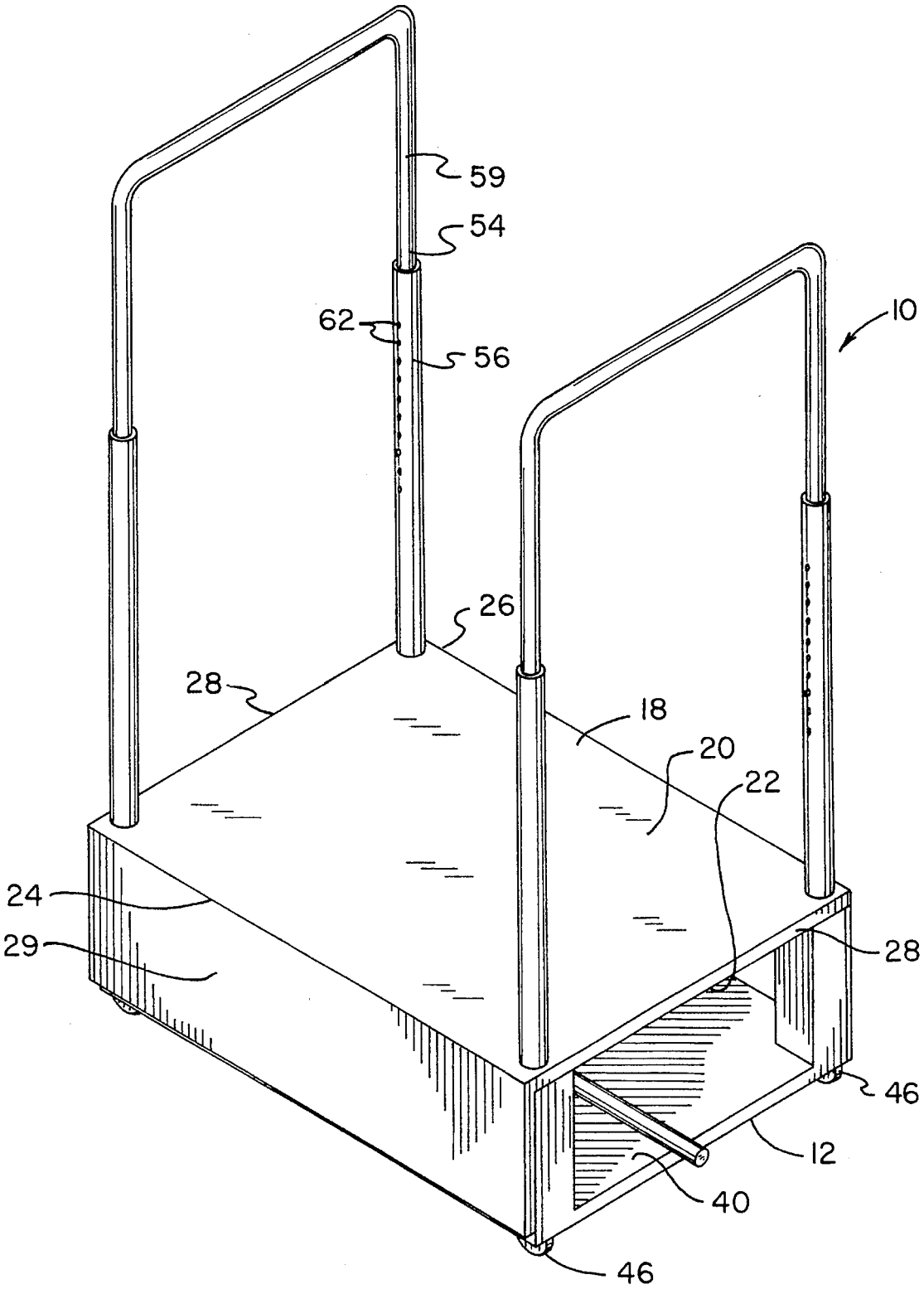
FIG. 1 is a perspective view of the preferred embodiment of the portable hydraulic lift step stool for raising handicapped patients to an elevated location constructed in accordance with the principles of the present invention.
Figure 2:
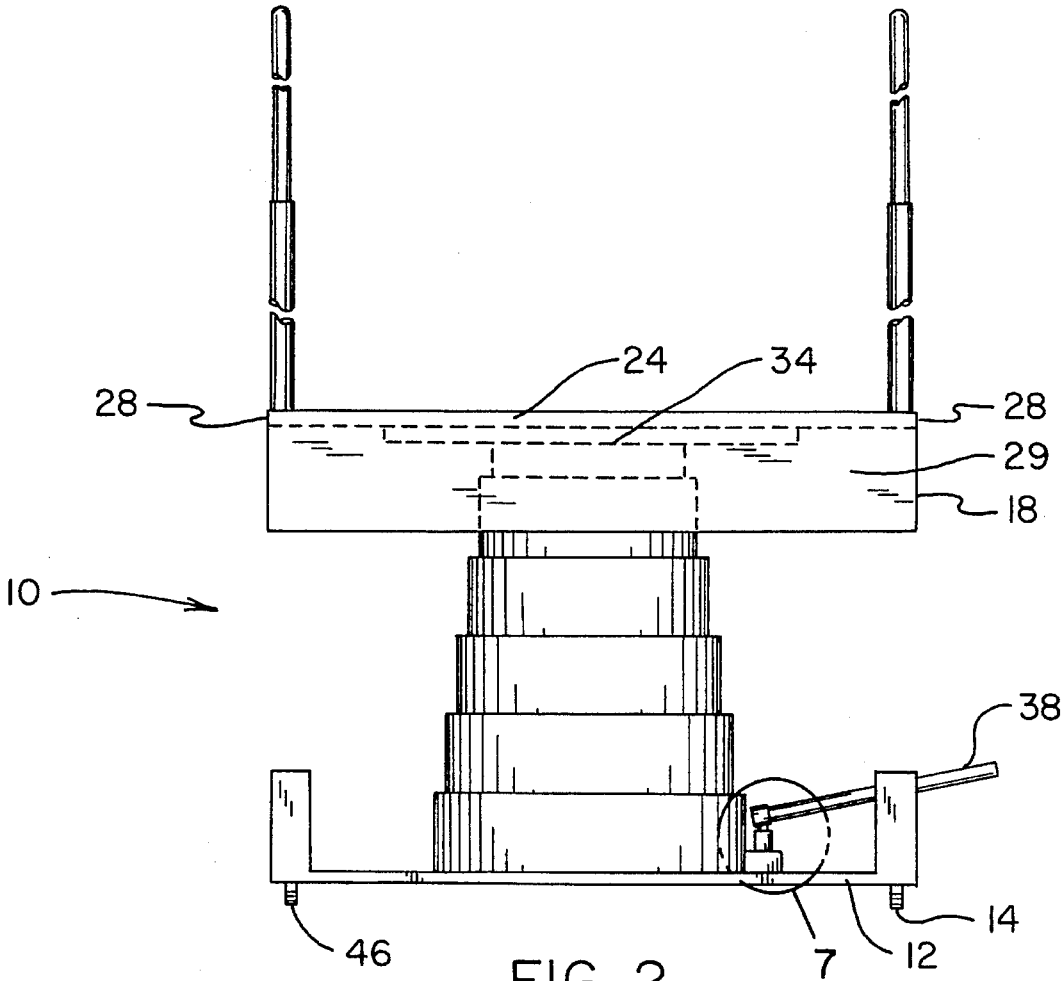
FIG. 2 is a front elevational view of the device shown in FIG. 1 but in an elevated orientation.
Figure 3:
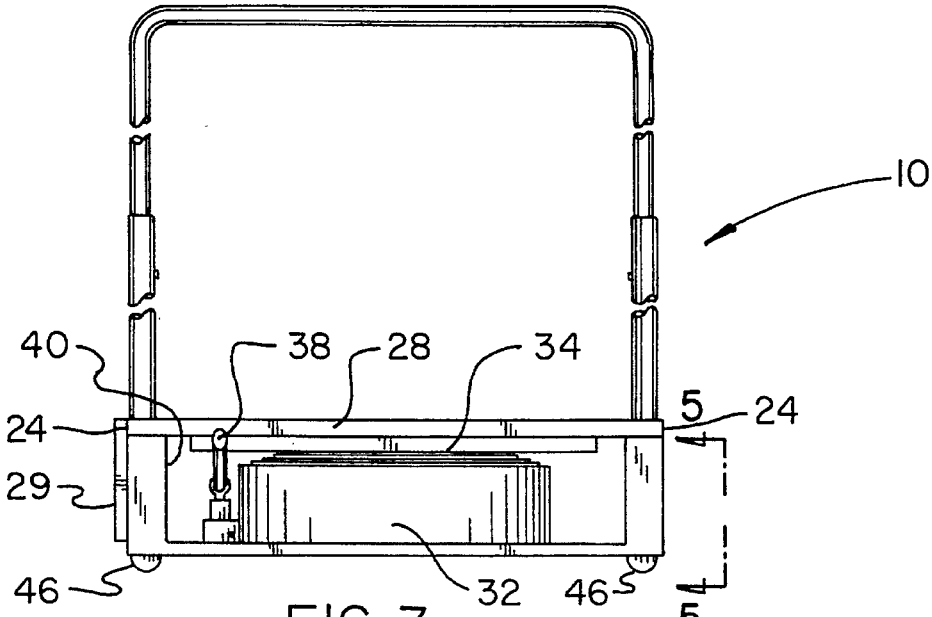
FIG. 3 is a side elevational view similar to FIG. 2 but illustrating the device in the collapsed orientation.
Figure 4:
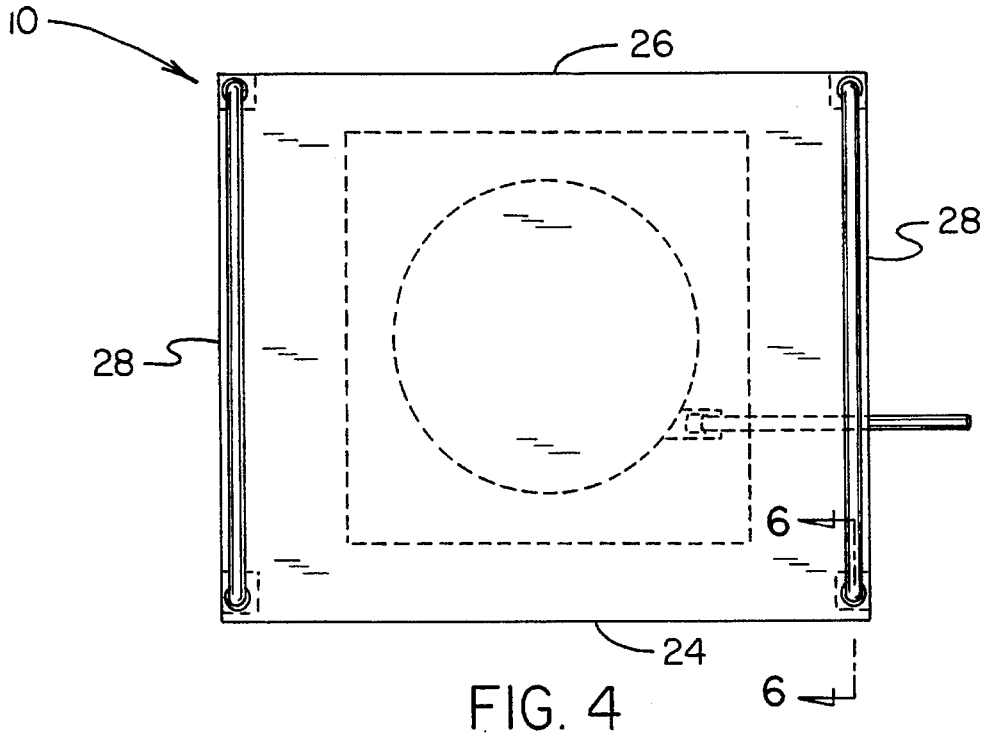
FIG. 4 is a top elevational view of the device shown in FIGS. 1 through 3.
Figure 5:
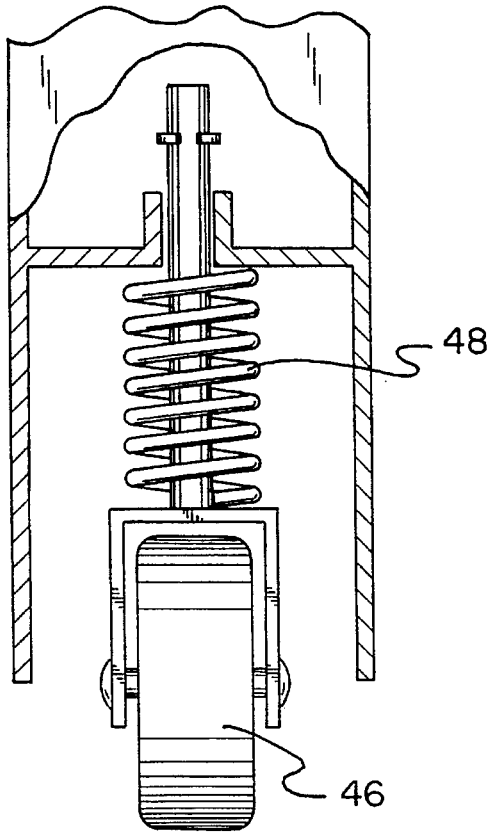
FIG. 5 is an enlarged view partly in section taken along line 5—5 of FIG. 3.
Figure 6:
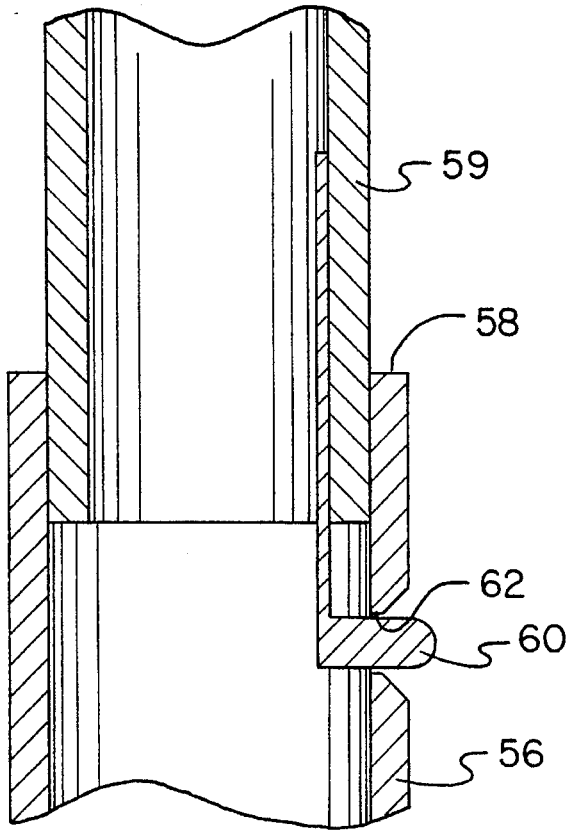
FIG. 6 is a cross sectional view of a portion of the handle taken along line 6—6 of FIG. 4.
Figure 7:
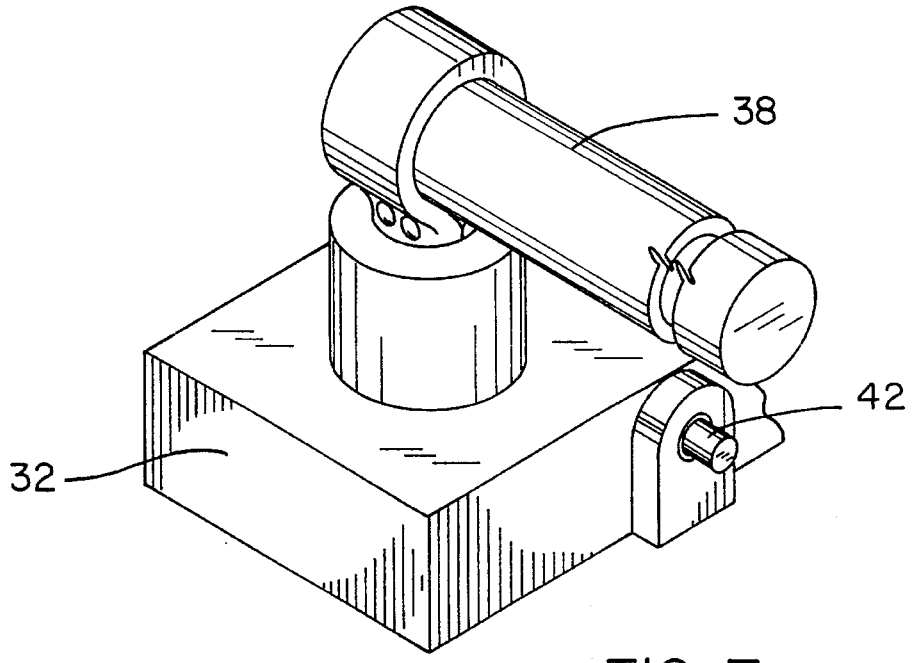
FIG. 7 is a perspective illustration of the coupling of the handle component taken about circle 7 of FIG. 2.

With reference now to the drawings, and in particular to FIG. 1 thereof, the preferred embodiment of the new and improved portable hydraulic lift step stool for raising handicapped patients to an elevated location embodying the principles and concepts of the present invention and generally designated by the reference numeral 10 will be described.

The present invention, the new and improved portable hydraulic lift step stool for raising handicapped patients to an elevated location is a system 10 comprised of a plurality of component elements, such component elements in their broadest context include a lower base, an upper base, a hydraulic jack, wheels and a pair of inverted U-shaped handles. Such components are individually configured and correlated with respect to each other so as to attain the desired objective More specifically, the system 10 of the present invention is built upon a lower base 12. such lower base is adapted to be positioned upon a floor 14. The lower base has parallel corner walls 16 extending upwardly therefrom.

The next component of the system is an upper base 18. The upper base is vertically reciprocable with respect to the lower base. It has a planar upper surface 20. Such upper surface is adapted to support a patient to be lifted and or transported. The lower surface 22 of the upper base faces the lower base and is spaced thereabove. The upper base has front and rear edges 24 and 26 with parallel side edges 28. It also has a downwardly extending plate 28 adapted to be positioned between and adjacent to the upwardly extending corner walls of the lower base.

Motion is provide to the upper base with respect to the lower base through a hydraulic jack 32. Such jack has an upper end 34 secured to the lower surface of the upper base. The jack also has a lower end secured to the upper surface of the lower base.

The hydraulic jack also includes a handle 38. Such handle extends outwardly from the upper base and lower base. It passes through a space 40 between the corner walls of the lower base. The handle is adapted to be pumped by an operator to raise and lower the jack and the upper base supported thereon. The jack also has a switch 42 for reversing the direction of movement of the jack and upper base in response to the reciprocation of a handle.

Next provided are a plurality of wheels 46. Such wheels are preferably four in number and depend downwardly from each corner of the lower base. An associated spring 48 is adapted to cushion the motion of the system 10 when rolled from one location to the other. The wheels also include locking mechanisms to secure the wheels against rotation during the raising and/or lowering of a patient thereon.

Lastly provided are a pair of inverted U-shaped handles 54. Such handles extend upwardly from the side edges of the upper base. Each handle includes lower fixed components 56 with vertically spaced apertures extending from the upper ends 58 thereof. The handles also include an upper inverted U-shaped component with downwardly extending free ends. Such free ends are positionable in the upper apertures of the lower components. In association therewith is a locking tongue 60 extending through one of a plurality of apertures 62 for securing the upper component at a predetermined fixed elevation with respect to the lower component and the upper base.

The present invention is a stool that is used to lift handicapped patients on and off examining tables and X-ray tables in a hospital or other medical facility. The stool is rectangular and measures 22 inches long by 18 inches wide. Its height can be adjusted from 4½ or 5 inches up to 20 inches by a hydraulic jack similar to those used on a dentist's chair. The hydraulic jack is operated by a foot pump positioned at the bottom of the stool. The stool has a non-slip surface to prevent a patent from sliding off. A removable, adjustable handrails is located on each of the 18 inch sides. It can be adjusted from 1 to 10 inches in 1 inch increments. The handrail is secured across the tops of two vertical tubes that are 19 inches long and are inserted into two vertical tubes that are 25 inches long. The outer tube has holes that are spaced 1 inch apart and drilled along its length. The inner tube has one or two holes that accept a locating pin to hold the tubes securely in place once the desired height has been attained. The handrail can be adjusted from 25 to 35 inches high. As previously noted the stool's height can be adjusted from 5 inches to 20 inches, enabling a patient to get on and off easily. A kick plate is positioned on one o the 22 inch sides, to prevent a patient's foot from being caught under the stool while getting on and off. Four wheels are positioned on the four corners of the present invention and these can be locked when loading and unloading a patient.

The present invention simplifies moving handicapped patients on and off examining tables and X-ray tables. It is easily transported and when not in use is easily stored.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable hydraulic lift step stool for raising handicapped patients to an elevated location comprising, in combination:

a lower base positionable upon a floor, the lower base having parallel corner walls extending upwardly therefrom;

an upper base having a planar surface, the upper surface of which is adapted to support a patient to be lifted and transported, the lower surface of which faces the lower base, the upper base having front and rear edges with a downwardly extending plate adapted to be positioned between the upwardly extending corner walls of the lower base;

a hydraulic jack having an upper end secured to the lower surface of the upper base and having a lower end secured to the upper surface of the lower base, the hydraulic jack including a handle extending outwardly from the upper base and lower base in a space between the corner walls of the lower base, the handle adapted to be pumped to raise and lower the hydraulic jack, the jack also having a switch for reversing the direction of movement of the jack;

wheels depending from each corner of the lower base with an associated spring adapted to cushion the motion of the system when rolled from one location to the other; and a pair of inverted U-shaped handles extending upwardly from the side edges of the upper base, each handle including lower fixed components with vertically spaced apertures and an upper inverted U-shaped component with downwardly extending free ends positionable in the upper apertures of the lower components each with a locking tongue for securing the upper component at a fixed elevation with respect to the lower component.

* * * * *